US006079178A

United States Patent [19]

Fisher

[11] Patent Number: 6,079,178

[45] Date of Patent: Jun. 27, 2000

[54] U-SHAPED STACKABLE TRUSS

[75] Inventor: Mark E. Fisher, London, United Kingdom

[73] Assignee: Tomcat Global Corporation, Midland, Tex.

[21] Appl. No.: 09/169,198

[22] Filed: Oct. 9, 1998

[51] Int. Cl.[7] ..... E04C 3/02

[52] U.S. Cl. ..... 52/690; 52/634; 52/638; 52/635; 52/636; 52/652.1; 52/655.1; 52/653.1; 52/653.2

[58] Field of Search ..... 52/690, 691, 692, 52/693, 694, 695, 696, 697, 634, 638, 635, 636, 652.1, 655.1, 653.1, 653.2, 645

[56] References Cited

U.S. PATENT DOCUMENTS

| | | | |
|---|---|---|---|
| 3,477,189 | 11/1969 | Merson | 52/650.3 |
| 3,744,206 | 7/1973 | Nelson et al. | 52/650.2 |
| 3,818,671 | 6/1974 | Matsushita et al. | 52/638 |
| 3,940,162 | 2/1976 | Winslow et al. | 52/694 |
| 5,205,101 | 4/1993 | Swan et al. | 51/650.1 |
| 5,335,468 | 8/1994 | Oberman et al. | 52/645 |
| 5,711,131 | 1/1998 | Thomas | 52/656.9 |
| 5,806,265 | 9/1998 | Sluiter | 52/643 |
| 5,822,945 | 10/1998 | Muller | 52/646 |

FOREIGN PATENT DOCUMENTS

| | | |
|---|---|---|
| 859752 | 11/1956 | United Kingdom . |
| 1088460 | 7/1965 | United Kingdom . |
| 1320777 | 6/1969 | United Kingdom . |

*Primary Examiner*—Christopher T. Kent
*Assistant Examiner*—Jennifer I. Thissell
*Attorney, Agent, or Firm*—Jones, Day, Reavis & Pogue

[57] ABSTRACT

A U-shaped stackable truss for use in temporary, demountable construction for exhibition, display, and concert staging.

13 Claims, 4 Drawing Sheets

U-SHAPED STACKABLE TRUSS

BACKGROUND OF THE INVENTION

1. Field of the Invention

The present invention relates in general to stackable trusses and in particular to a U-shaped stackable truss for use in temporary, demountable construction for exhibition, display, and concert staging.

2. Description of Related Art Including Information Disclosed under 37 CFR 1.97 and 1.98

As is well known in the prior art, there is a great need for the construction of exhibition, display, and concert staging that requires the use of truss members that can be connected together in a well-known fashion to form a finished stage or exhibition. Many of these exhibitions or staging displays are quite elaborate and are associated with groups such as music groups that travel from one location to another to perform concerts. This means that the staging must be shipped to the desired location, assembled, the concert performed, the staging disassembled, and shipped again to the next location for the next concert.

As is well known, the shipping of the truss units is very expensive because the assembled truss units require a great amount of space. This means, of course, that the greater number of trucks and personnel that are required to ship the staging trusses, the greater is the expense.

In an effort to cut down on space required, copending application Ser. No. 08/902,404, entitled "Truss", was filed on Aug. 9, 1997, to provide a V-shaped stackable truss that could be stacked in a snug manner to take up less space during shipment. This enables the truss member to be shipped from one location to another at a much less cost than previously required.

Further, a V-shaped stackable truss has been disclosed in commonly assigned copending application Ser. No. 09/169,080, entitled "V-Shaped Stackable Truss That Is Selectively Braceable", and filed on even date herewith. It enables the V-shaped stackable trusses to be selectively braced in order to allow them to be strengthened and to carry greater loads.

In some instances, it is advantageous to have trusses that are of a U-shape but that can be stacked when assembled for storage and that can be easily disassembled for shipment in a flat state.

SUMMARY OF THE INVENTION

The present invention enables the formation of a U-shaped stackable truss that utilizes a former having a substantially U-shaped frame with a base forming the closed end of the U-shaped frame and first and second spaced ends on the base. First and second legs depend from the spaced ends of the base in a substantially parallel relationship and each of the first and second legs has an outer end. A bracket member is formed on each of the first and second spaced ends of the base and on the outer end of each depending leg for enabling an elongated chord member to be removably attached to corresponding ones of the bracket members on a plurality of spaced ones of the U-shaped frames to form a substantially U-shaped stackable truss.

In order that the trusses formed with the U-shaped frames can be stacked, first and second spaced salient surfaces are formed on the inner edge of the base of each U-shaped frame to enable stacking of two of the U-shaped trusses in open-end-to-open-end relationship to form a stacked set. The first and second salient surfaces on the inner edge of each of the U-shaped frames on one of the stacked U-shaped trusses matingly receives corresponding chords on the outer ends of the legs of the other stacked U-shaped truss.

In addition, third and fourth spaced salient surfaces are formed on the outer edge of the base of each U-shaped frame for enabling stacking of two of the U-shaped trusses base-to-base. The third and fourth spaced salient surfaces on the outer edge of the base of each of the U-shaped frames matingly receive corresponding chords on the first and second spaced ends of the base of the other U-shaped truss stacked back-to-back. Thus, the third and fourth spaced salient surfaces enable stacking of a plurality of the stacked sets to conserve space during storage and shipment of the U-shaped trusses.

The U-shaped stackable truss itself comprises a plurality of spaced, open-ended U-shaped formers with each U-shaped former having a base with first and second ends and spaced, substantially parallel legs depending from the first and second ends and forming the open end of the "U". Each spaced leg has an outer end and there is a bracket member on each end of the base and on the outer end of each of the depending legs. An elongated chord member is detachably coupled to corresponding ones of the bracket members in the plurality of U-shaped formers to form a substantially U-shaped truss. Salient surfaces on the base enable the U-shaped trusses to be stacked both open-end-to-open-end and base-to-base.

Thus, it is an object of the present invention to provide a U-shaped former that can be used in creating a U-shaped stackable truss.

It is still another object of the present invention to provide a U-shaped stackable truss that can be easily assembled and disassembled for storage, use, and shipping.

It is also an object of the present invention to provide the substantially U-shaped former with salient surfaces on the inner and outer edges of the base so that trusses can be stacked either open-end-to-open-end or base-to-base.

Thus, the present invention relates to a U-shaped stackable truss comprising a plurality of spaced, open-ended U-shaped formers, each U-shaped former having a base with first and second ends and spaced substantially parallel legs depending from the first and second ends of the base and forming the open end, each spaced leg having an outer end, a bracket member on each end of the base and on the outer end of each of the depending legs with an elongated chord member being detachably coupled to corresponding ones of the bracket members on the plurality of U-shaped formers to form a substantially U-shaped truss. Salient surfaces are formed on the outer and inner edges of the base for enabling the U-shaped trusses to be stacked both open-end-to-open-end and base-to-base.

The invention also relates to a former for use in creating a U-shaped stackable truss comprising a substantially U-shaped frame, a base forming the closed end of the U-shaped frame, first and second spaced ends on the base, first and second substantially parallel legs depending from the first and second ends of the base, each leg having an outer end, a first bracket member on each of the first and second spaced ends of the base and a second bracket member on the outer end of each depending leg for enabling an elongated chord member to be detachably connected to corresponding ones of the first and second bracket members on a plurality of spaced ones of the U-shaped frames to form a substantially U-shaped stackable truss.

BRIEF DESCRIPTION OF THE DRAWINGS

These and other features of the present invention will be more fully disclosed when taken in conjunction with the following Detailed Description of the Preferred Embodiment(s) in which like numerals represent like elements and in which.

DETAILED DESCRIPTION OF THE PREFERRED EMBODIMENT(S)

Figure 1:
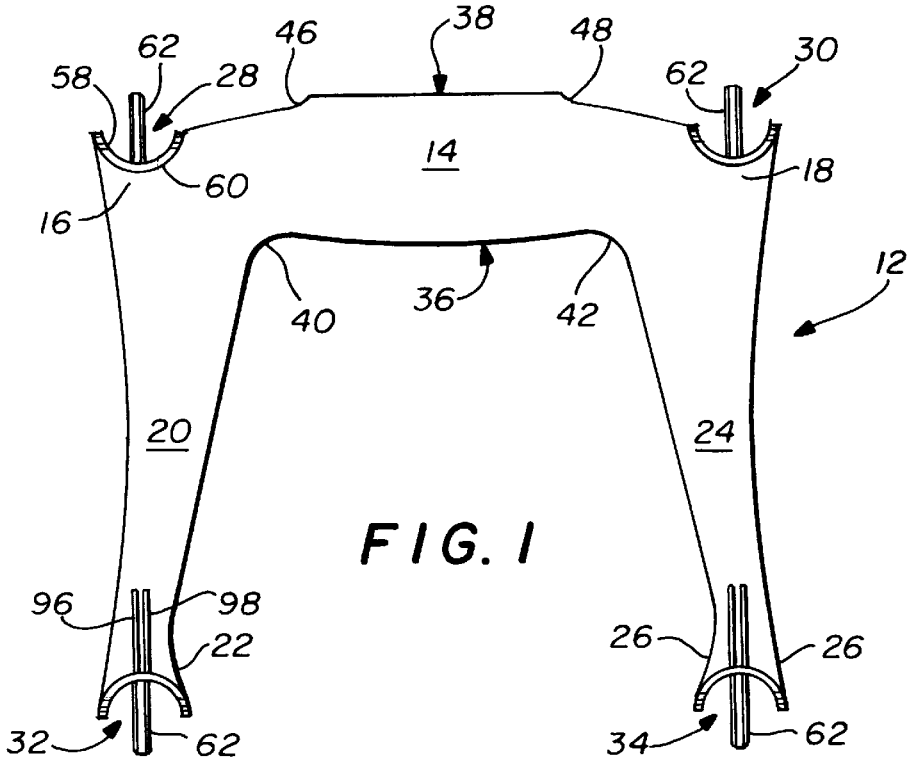
FIG. 1 is a plan view of one of the novel U-shaped formers of the present invention.

FIG. 1 is a plan view of the novel former 12 of the present invention that is used in creating a U-shaped stackable truss. It comprises a substantially U-shaped frame 12 having a base 14 forming a closed end of the U-shaped frame 12. It has first and second spaced ends 16 and 18 on the base 14. A first leg 20 depends from the first spaced end 16 of the base 12 and has an outer end 22. A second leg 24 is substantially parallel to the first leg 20 and depends from the second spaced end 18 of the base 12 and has an outer end 26. A first bracket member 28 and 30 on each of the first and second spaced ends 16 and 18 of base 12 and a second bracket member 32, 34 on the outer end 22, 26 of each of the depending leg 20, 24 enables an elongated chord member 50, 52, 54, 56 (as shown in FIGS. 2–5) to be attached to corresponding ones of the first and second bracket members 28, 30, 32, 34 on a plurality of spaced ones of the U-shaped frames 12 to form a substantially U-shaped stackable truss as shown in FIGS. 2 and 3.

Figure 9:
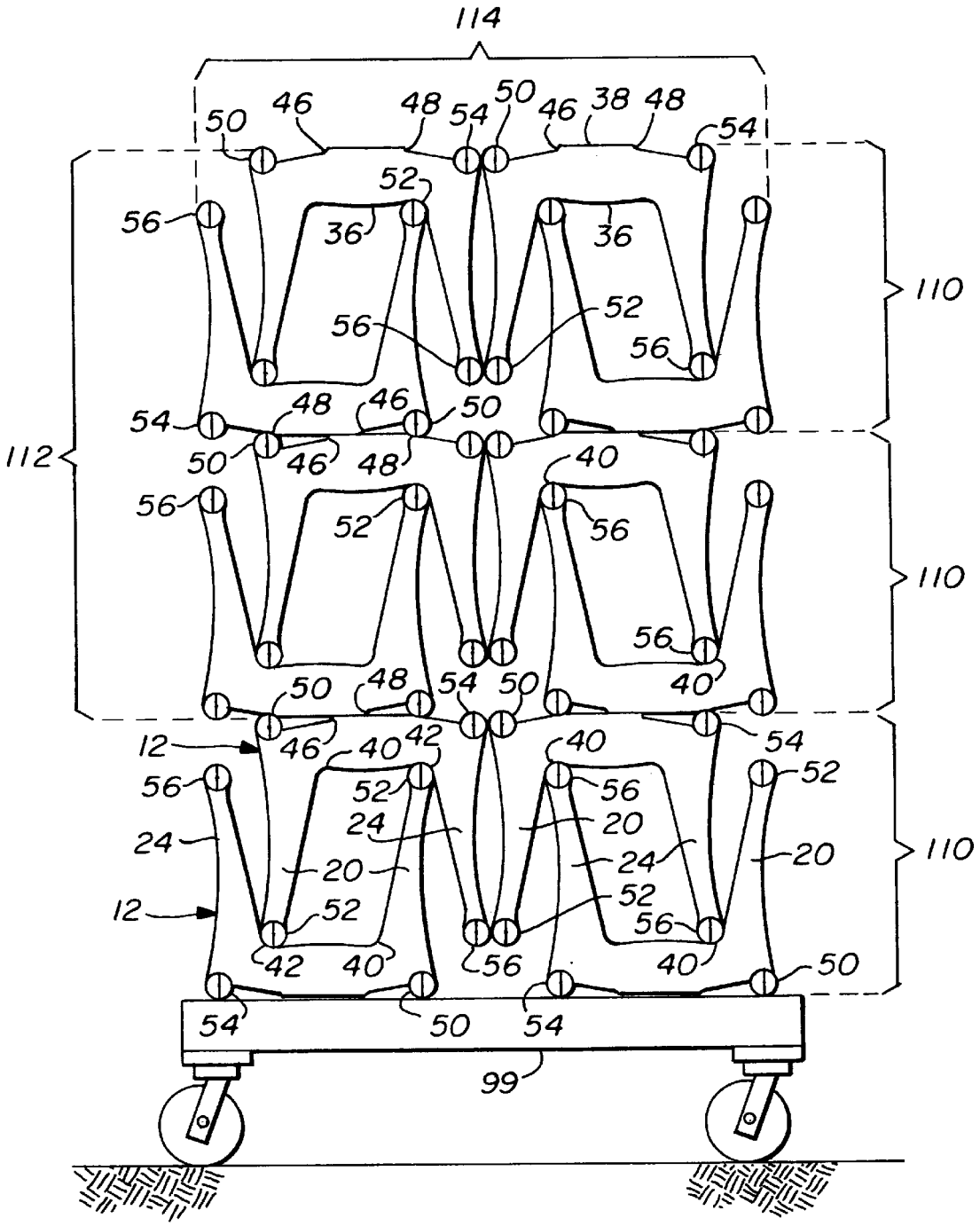
FIG. 9 is an end view of the stacked U-shaped trusses of FIG. 8 illustrating the manner in which they are stacked in open-end to open-end relationship and also in a back-to-back relationship.

It will be noted in FIG. 1 that base 14 has an inner edge 36 and an outer edge 38. First and second spaced salient surfaces or shoulders 40, 42 are formed on the inner edge 36 of the base 12 of each U-shaped frame 12 to enable stacking of two of the U-shaped trusses 10 in an open-end-to-open-end relationship to form a first stacked set 110 as illustrated in FIG. 9. At least one of the first and second spaced salient surfaces 40, 42 on the inner edge 36 of each of the U-shaped frames 12 on one of the stacked U-shaped trusses 10 matingly receives one of the corresponding chords 52, 56 on the outer ends of the legs 20, 24 of the other stacked U-shaped truss 10 as will be explained hereafter. Third and fourth spaced salient surfaces or shoulders 46, 48 are formed on the outer edge 38 of the base of each U-shaped frame 12 for enabling stacking of two of the U-shaped trusses 10 base-to-base to form a second stacked set 112 as shown in FIG. 9. In that set, at least one of the third and fourth spaced salient surfaces or shoulders 46, 48 on the outer edge 38 of the base 14 of each of the U-shaped frames 12 matingly receives a corresponding one of the chords 48 on the first and second spaced ends 16, 18 of the base 14 of the other U-shaped truss stacked back-to-back. The third and fourth spaced salient surfaces or shoulders 46, 48 enable stacking of a plurality of said stacked sets 110 both base-to-base and open-end-to-open-end as shown in FIG. 9 to conserve space during storage and shipment of the U-shaped trusses.

Figure 2:
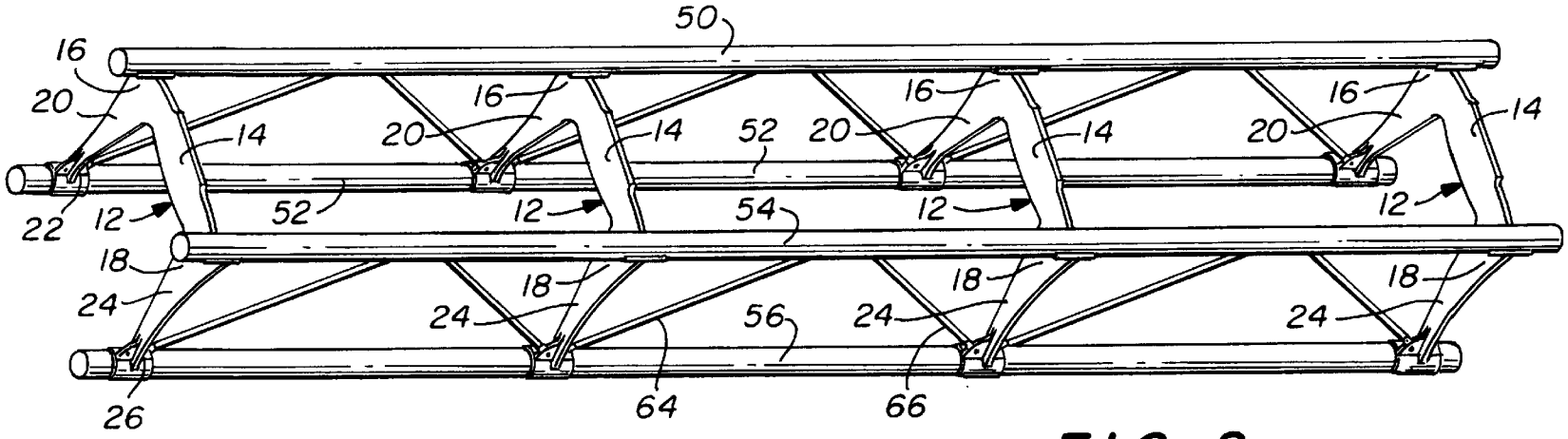
FIG. 2 is a perspective view of the novel U-shaped truss of the present invention taken from the top.
Figure 3:
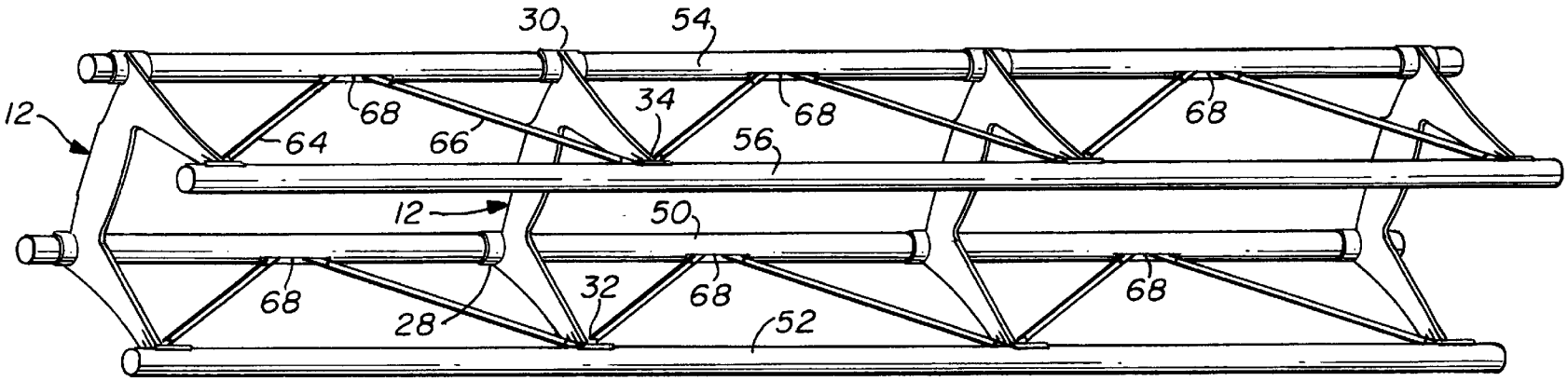
FIG. 3 is a perspective view of the novel U-shaped truss as seen from the bottom.

To a construct a U-shaped stackable truss 10 as shown in FIG. 2 and FIG. 3, the bracket members 28, 30, 32, and 34 shown in FIG. 1 are used. Each bracket member has a first side 58 with a shape conforming to at least a portion of the periphery of the elongated chord members 50, 52, 54, and 56 (shown in FIGS. 2 and 3) and a second side 60 joined to said U-shaped former 12 as shown in FIG. 1. It is clear that the U-shaped former 12 may be formed of molded plastic or otherwise extruded of metal. In addition, each of the bracket members 28, 30, 32, and 34 could be attached to the U-shaped former 12 as shown by any well-known means such as integral molding or attaching it after former 12 with its base and depending legs has been manufactured.

Figure 4:
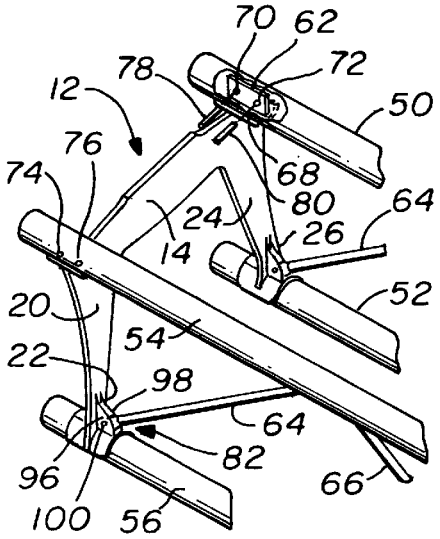
FIG. 4 is an enlarged partial view of one of the ends of the U-shaped truss with a cutaway illustrating the manner in which the chords are attached to the formers to more clearly disclose its construction.

It will be noted that a plate 62 extends outwardly from the first side 58 of each of the brackets 28, 30, 32, and 34 and spaced aligned slots 68 in each of elongated chord members 50, 52, 54, and 56 (as shown in FIG. 4) removably receive the plate 62 on the corresponding brackets 28, 30, 32, and 34 at each outer end 16, 18 of the base 14 and on the outer end 22, 26 of each of the depending legs 20, 24 for forming the U-shaped stackable truss.

Figure 5:
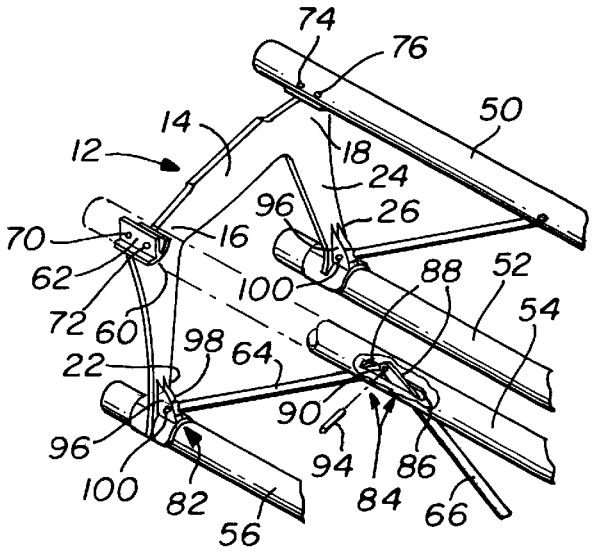
FIG. 5 is an enlarged partial view of one end of the novel U-shaped truss with cutaways illustrating the manner in which the braces are attached between the formers and the chords.

As can be seen most clearly in FIG. 4 and FIG. 5, at least one first orifice 70, 72 is formed in each of the plates 62. At least one corresponding second orifice 74 and 76 in each of the elongated chord members 50, 52, 54, and 56 is in aligned relationship with the at least one first orifice 70, 72 in each of the plates 62. Pins 78, 80 are for insertion in the aligned orifices 70, 72, 74, 76 for detachably connecting the U-shaped formers 12 to the elongated chord members 50, 52, 54, and 56 to form the stackable truss 10.

As can be seen in FIGS. 2, 3, 4, and 5, diagonal bracing tubes 64, 66, each having first and second ends 82 and 84, are releasably connected between the U-shaped formers 12 and the elongated chord members 50, 52, 54, and 56. A first end 84 of at least one of the diagonal bracing tubes 64, 66 is releasably connected to a selected elongated chord member 50, 54 as shown in FIGS. 4 and 5 at a point between corresponding aligned base ends 16 and 18 of adjacent U-shaped formers 12. The second end 82 of the at least one diagonal bracing tube 64, 66 is releasably connected to the outer end 22 or 26 of leg 20 or 24 depending from the base end 16, 18 to which the selected elongated chord member 52, 56 is connected.

As can best be seen in FIG. 5, a slot 86 in the elongated chord member 50, 54 at the point between aligned base ends 14 of the adjacent U-shaped formers 12 receives a male connector 88 formed on the first end 84 of the diagonal bracing tube 64, 66 for insertion in the slot 86. Aligned orifices 90 (in the male connector 88) and 92 (in the elongated chord member 54) receive a pin 94 to releasably attach the first end 84 of the diagonal bracing tube 64, 66 to the elongated chord member 54 as shown.

As can be seen in FIGS. 4 and 5, a female flange 96 is formed on the outer end 22, 26 of the at least one leg 20, 24 of the U-shaped former 12. A male connector 98 is formed on the second end 82 of the diagonal bracing tube 64, 66 for insertion in the female flange 96. Aligned orifices 100 as shown in FIG. 5 in the male connector 98 and the female flange 96 receive a pin such as pin 94 to releasably and rigidly attach the second end 82 of the diagonal bracing tube 64, 66 to the outer end 22, 26 of the at least one leg 20, 24 of the U-shaped former 12.

Figure 6:
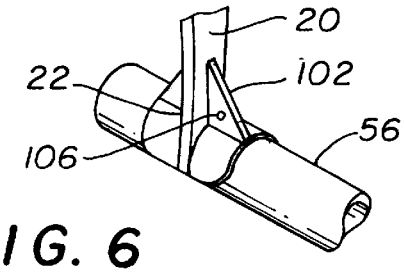
FIG. 6 and FIG. 7 illustrate an alternative embodiment for connecting the diagonal bracing tube to the outer end of one of the legs of the formers with FIG. 7 illustrating one end of a diagonal bracing tube having a female connection thereon with an orifice for mating with a male connector such as shown in FIG. 6.
Figure 7:
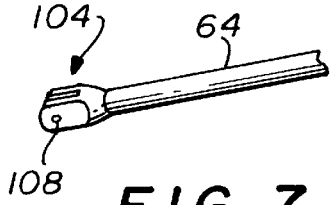

If desired, the modifications shown in FIG. 6 and FIG. 7 can be used. There, a male connector 102 on the outer end 22, 26 of each leg 20, 24 of the U-shaped former 12 is inserted in the female flange 104 shown in FIG. 7 that is formed on the second end 82 of the diagonal bracing tube 64. Thus the female flange 104 receives the male connector 102 on the outer end of the corresponding leg 20 of the U-shaped former 12. Aligned orifices 106, 108 in the male connector 102 and the female flange 104 receive a pin such as pin 94 in FIG. 5 to releasably and rigidly attach the second end 82 of the diagonal bracing tube 64 to the corresponding leg 20 of the U-shaped former 12.

Clearly, if the U-shaped formers 12 are formed of molded plastic, then each of the bracket members 28, 30, 32, and 34 may be integrally molded as an integral part of the U-shaped former 12. They can, of course, be attached physically to the former 12 in any well-known manner after the former 12 has been manufactured.

It will be noted most clearly in FIG. 1 that there is an inner edge 36 and an outer edge 38 formed on the base 14 of each of the U-shaped formers 12. Further, first and second spaced salient surfaces or shoulders 40, 42 are formed on the inner edge 36 of the base 14 of each U-shaped former 12 for enabling stacking of two of the U-shaped trusses 10 open-end-to-open-end to form a stacked set 110 as shown in FIG. 9. At least one of the first and second spaced salient shoulders 40, 42 on each of the U-shaped formers 12 on one of the stacked U-shaped trusses 10 matingly receives the corresponding chord 52 on the outer end of at least one of the legs of the other U-shaped formers 12 on the other stacked U-shaped truss 10. Further, third and fourth spaced salient surfaces 46, 48 are formed on the outer edge 38 of the base 14 of each U-shaped former 12 for enabling stacking of two of the U-shaped trusses 10 base-to-base to form a set 112 as shown in FIG. 9. The third and fourth spaced salient surfaces 46, 48 on each of the U-shaped formers 12 matingly receive corresponding chords on the first and second ends of the base of the other U-shaped formers on the other U-shaped truss stacked base-to-base. The third and fourth salient surfaces or shoulders enable stacking of a plurality of the stacked sets 110 to conserve space during storage and shipment of the U-shaped trusses.

Figure 8:
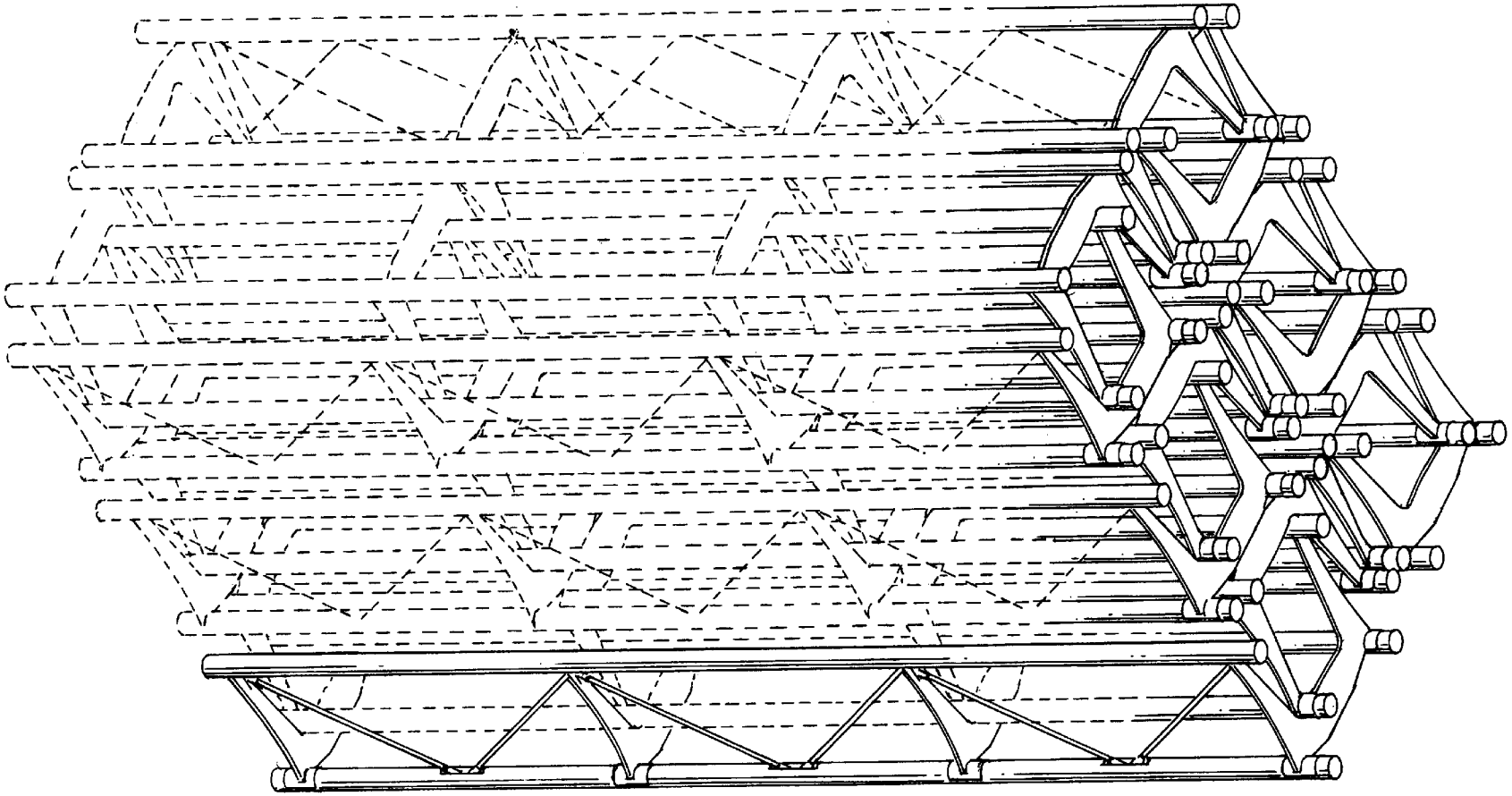
FIG. 8 is an isometric view of a plurality of the U-shaped trusses in a stacked relationship.

FIG. 8 illustrates in a perspective view six sets of trusses in a stacked relationship.

FIG. 9 is an end view of the stacked trusses of FIG. 8 placed on a platform 99.

Note, in FIG. 9, that there are two stacks 114 of three sets 110 of stacked trusses in each stack. Note that each set 110 is stacked open-end-to-open-end while the two sets 112 overlap and are stacked base-to-base. In the stack on the left in FIG. 9, it can be seen in the bottom set that the bottom former 12 is inverted and the adjacent upper former 12 is inserted with its leg 20 inside the U-shaped former 12 with its chord 52 on the outer end of leg 20 mating with the salient surface or shoulder 42. In like manner, the upper former 12 of the set 110 receives the chord 52 on the outer end leg 20 of the inverted former 12 in its salient surface or shoulder 42. Thus, the two inverted trusses facing each other in an open-end-to-open-end relationship lock with each other because of the salient surfaces or shoulders 42 and the corresponding chords 52 resting therein.

In the right stack of FIG. 9, the bottom stack 110 is simply reversed. That is, the chord 56 on the outer end of leg 24 of the upper former 12 mates with the salient surface or shoulder 40 of the lower truss former 12. In like manner, the adjacent upper former 12 receives the chord 56 on the outer end of leg 24 of the lower inverted former 12 in mating recess with the salient surface 40 on the inner edge of the base 14 of the upper former 12. When placed as shown in FIG. 9, the two stacked sets brace each other.

As can be seen in FIG. 9, the stacked sets 110 can be stacked base-to-base to form a stacked set 112 as shown. In that case, the chord 50 on one of the outer edges of the base 14 of the lower former of the upper most set in FIG. 9 on the left side engages or is matingly received by the salient surface or shoulder 48 of the base 14 of the upper former 12 of the lower set 110. As can be seen, in like manner, the chord 50 of the upper former of the lower set of stacked trusses engages or is matingly received by the salient surface or shoulder 48 of the lower truss of the upper set of stacked trusses 110. Thus as can be seen, two sets of stacked trusses 110 can be stacked base-to-base to form a set 112.

The corresponding structures, materials, acts, and equivalents of all means or step plus function elements in the claims below are intended to include any structure, material, or act for performing the function in combination with other claimed elements as specifically claimed.

I claim:

1. An elongated U-shaped stackable truss comprising:

a plurality of spaced, open-ended U-shaped formers;

each U-shaped former having a base with first and second spaced outer ends and spaced, substantially parallel legs depending from said first and second spaced outer ends and forming said open end;

each leg having an outer end;

a bracket member on each spaced outer end of said base and on the outer end of each of said depending legs; and an elongated chord member being detachably coupled to a corresponding one of each of said bracket members in said plurality of U-shaped formers to form a substantially U-shaped truss.

2. The U-shaped stackable truss of claim 1 further comprising salient surfaces on said base for enabling said U-shaped trusses to be stacked both open-end-to-open-end and base-to-base.

3. The U-shaped stackable truss of claim 1 wherein:

said bracket members each having a first side with a shape conforming to at least a portion of the periphery of said elongated chord members, and a second side joined to said U-shaped former;

a plate extending outwardly from the first side of each of the brackets; and spaced, aligned slots in each of said elongated chord members for removably receiving said plate on corresponding bracket members at each end of said base and on the outer end of each of said depending legs for forming a U-shaped stackable truss.

4. The stackable truss of claim 3 further comprising:

at least one first orifice in each of said plates;

at least one corresponding second orifice in each of said elongated chord members in aligned relationship with said at least one first orifice in each of said plates; and pins for insertion in said aligned orifices for detachably connecting said U-shaped formers to said elongated chord members to form said stackable truss.

5. The stackable truss of claim 1 further comprising:

diagonal bracing tubes each having first and second ends and being releasably connected between said U-shaped formers and said elongated chord members;

a first end of at least one of said diagonal bracing tubes being releasably connected to a selected elongated chord member at a point between corresponding aligned base ends of adjacent U-shaped formers; and the second end of said at least one diagonal bracing tube being releasably connected to the outer end of the leg depending from said base end to which said selected elongated chord member is connected.

6. The stackable truss of claim 5 further comprising:

a slot in said elongated chord member at said point between aligned base ends of adjacent U-shaped formers;

a male connector formed on said first end of said diagonal bracing tube for insertion in said slot; and aligned orifices in said male connector and said elongated chord member for receiving a pin to releasably attach said first end of said diagonal bracing tube to said elongated chord member.

7. The stackable truss of claim 6 further comprising:

a female flange on the outer end of at least one leg of said U-shaped former;

a male connector formed on the second end of said diagonal bracing tube for insertion in said female flange; and aligned orifices in said male connector and said female flange for receiving a pin to releasably and rigidly attach said second end of said diagonal bracing tube to said outer end of said at least one leg of said U-shaped former.

8. The stackable truss of claim 5 further comprising:

a male connector on each leg outer end of said U-shaped former;

a female flange formed on said second end of said diagonal bracing tube for receiving said male connector on the outer end of a corresponding leg of said U-shaped former; and aligned orifices in said male connector and said female flange for receiving a pin to releasably and rigidly attach said second end of said diagonal bracing tube to said corresponding leg of said U-shaped former.

9. The stackable truss of claim 1 wherein said U-shaped formers are formed of molded plastic.

10. The stackable truss of claim 9 wherein each of said bracket members is integrally molded as an integral part of said U-shaped former.

11. The stackable truss of claim 9 further comprising:

an inner face formed on the base of each of said U-shaped formers facing said open end of said U; and first and second spaced salient surfaces formed on said inner face of said base of each of said U-shaped formers for enabling stacking of two of said U-shaped trusses open-end to open-end and in which at least one of said first and second spaced salient surfaces on said inner face of one of said two U-shaped formers is adapted to mate with a corresponding chord member on the outer end of at least one of the legs of the other one of said two U-shaped formers to enable two U-shaped trusses to be stacked one upon the other open-end-to-open end.

12. The stackable truss of claim 9 further comprising:

an outer face formed on the base of each of said U-shaped formers facing opposite said open end; and first and second spaced salient surfaces formed on said outer face of said base of each of said U-shaped formers for enabling stacking of two of said U-shaped trusses base-to-base and in which said first and second spaced salient surfaces on each of said U-shaped formers are adapted to mate with corresponding elongated chords on the first and second spaced outer ends of the base of the opposing one of the two U-shaped formers to enable two of said U-shaped trusses to be stacked one upon the other base-to-base.

13. The stackable truss of claim 11 further comprising:

third and fourth spaced salient surfaces formed on said outer edge of said base of each U-shaped former for enabling stacking of two of said U-shaped trusses base-to-base, said third and fourth spaced salient surfaces on each of said U-shaped formers matingly receiving corresponding chords on the first and second ends of the base of the other U-shaped formers on the other U-shaped truss stacked back-to-back; and said third and fourth salient shoulders enabling stacking of a plurality of said stacked sets to conserve space during storage and shipment of said U-shaped trusses.

* * * * *